US010245605B2

(12) United States Patent
Hou

(10) Patent No.: US 10,245,605 B2
(45) Date of Patent: Apr. 2, 2019

(54) STRUCTURE OF LIQUID CONTAINER

(71) Applicant: Hsin Yu Hou, Taipei (TW)

(72) Inventor: Hsin Yu Hou, Taipei (TW)

( * ) Notice: Subject to any disclaimer, the term of this patent is extended or adjusted under 35 U.S.C. 154(b) by 0 days.

(21) Appl. No.: 15/682,078

(22) Filed: Aug. 21, 2017

(65) Prior Publication Data

US 2018/0056312 A1 Mar. 1, 2018

(51) Int. Cl.

| | |
|---|---|
| ***B05B 11/00*** | (2006.01) |
| ***B05B 9/04*** | (2006.01) |
| ***A45D 34/00*** | (2006.01) |
| ***A45D 34/06*** | (2006.01) |
| ***A45D 40/24*** | (2006.01) |
| ***B05B 1/16*** | (2006.01) |
| ***B05B 11/06*** | (2006.01) |
| ***B05B 12/14*** | (2006.01) |
| ***B05B 15/70*** | (2018.01) |

(52) U.S. Cl.

CPC ..... *B05B 9/0406* (2013.01); *A45D 34/00* (2013.01); *A45D 34/06* (2013.01); *A45D 40/24* (2013.01); *B05B 1/169* (2013.01); *B05B 1/1645* (2013.01); *B05B 9/0413* (2013.01); *B05B 11/0037* (2013.01); *B05B 11/0038* (2018.08); *B05B 11/0039* (2018.08); *B05B 11/06* (2013.01); *B05B 11/3059* (2013.01); *B05B 11/3084* (2013.01); *B05B 12/1409* (2013.01); *B05B 15/70* (2018.02); *A45D 2200/25* (2013.01); *B05B 11/0089* (2013.01)

(58) Field of Classification Search

CPC ..... B05B 9/0406; A45D 34/00; A45D 34/06

USPC ..... 222/132, 135, 136, 142.2, 142.3, 142.6, 222/144.5, 182, 336, 402.13, 402.17, 514

See application file for complete search history.

(56) References Cited

U.S. PATENT DOCUMENTS

| | | | | | |
|---|---|---|---|---|---|
| 1,964,362 | A * | 6/1934 | Nassif | B05B 11/0056 | 222/136 |
| 3,596,802 | A * | 8/1971 | Feldman | B65D 83/68 | 222/135 |
| 4,006,841 | A * | 2/1977 | Alticosalian | B65D 83/205 | 222/135 |
| 4,238,054 | A * | 12/1980 | Chen | B67D 1/0425 | 222/131 |
| 4,549,674 | A * | 10/1985 | Alticosalian | B65D 83/205 | 222/135 |
| 5,152,431 | A * | 10/1992 | Gardner | B05B 11/3081 | 222/136 |
| 5,433,350 | A * | 7/1995 | Graubart | B05B 11/3011 | 222/136 |
| 6,659,311 | B2 * | 12/2003 | Prueter | B05B 11/3081 | 222/136 |
| 6,945,430 | B2 * | 9/2005 | Bloc | B05B 11/3084 | 222/135 |

(Continued)

*Primary Examiner* — Vishal Pancholi

(57) ABSTRACT

A liquid container includes a casing, at least two inner bottles for containing liquids, at least one pumping unit, a turnable selecting mechanism, and a top cover. The inner bottles are received in the casing and covered by the top cover. The selecting mechanism is operated to select one of the inner bottles to be pumped, and then the pumping unit is operated to pump out the liquid contained in the selected inner bottle through an outlet located on the top cover. Not only weight and volume for carrying these liquids can be decreased, but also convenience for accessing these liquids is improved by using the aforesaid liquid container.

10 Claims, 16 Drawing Sheets

(56) References Cited

U.S. PATENT DOCUMENTS

| | | | | |
|---|---|---|---|---|
| 8,777,037 | B2 * | 7/2014 | Knopow | B05B 7/2443 134/172 |
| 8,800,818 | B2 * | 8/2014 | Greenberg | B05B 11/3059 222/135 |
| 2010/0044394 | A1 * | 2/2010 | Milian | B05B 11/3007 222/135 |
| 2014/0217120 | A1 * | 8/2014 | Berry | B05B 11/3081 222/136 |

* cited by examiner

STRUCTURE OF LIQUID CONTAINER

This application claims the benefit of Taiwan Patent Application Serial No. 105127063, filed on Aug. 24, 2016, the subject matter of which is incorporated herein by reference.

BACKGROUND OF INVENTION

1. Field of the Invention

The invention relates to a structure of liquid container, and more particularly to the liquid container that has a casing and a cover assembly to integrate thereinside at least two bottles, and introduces a selecting mechanism and a pumping unit to selectively perform a squeezing-out process upon one of the bottles.

2. Description of the Prior Art

Currently, various and versatile female cosmetic and care products have been presented to the marketplace. Generally, to a person, especially a lady, plenty of the aforesaid products would be used daily. In particular, some of those products are applied in an anytime base, and thus carrying of these products, usually in a bottle form for liquid products, would be, or definitely, notorious to the users. Sometimes, a large cosmetic packet would be applied to collect these bottled products. However, due to sales policies of some manufacturers, small-sized bottled products might not be available all the time, thus carrying of large-volumed bottles (such as those for containing toning water, makeup removers, care lotions, liquid foundations and so on) would be troublesome to the daily users or users in a short trip. To overcome the aforesaid inconvenience, some small-volumed glass or plastic bottles might be used to carry limited volumes of these liquid care and/or cosmetic products. However, too many bottles still cause problems in portability, collectivity and convenience.

Hence, in viewing the aforesaid shortcomings in the art, the present invention is to provide an improvement of a liquid container for resolving the inconvenience caused by the company of plenty bottles of the cosmetics. This improved liquid container applies a unique casing to collect thereinside a plurality of inner bottles for containing different liquid contents. Further, by applying a top cover to seal the casing and a selecting mechanism to select one of the inner bottles to be squeezed, then a pumping unit can be used to pump out the specific liquid content of the chosen inner bottle through a liquid outlet of the top cover. Thereupon, the goal of carrying a single container able to provide different liquid contents can thus be achieved, so that the volume and weight to be carried can be substantially reduced. Thereby, easy collection, convenience and compactness from using the improvement of the liquid container can be obtained, and thus practicality and market development of this improved liquid container can be foreseen.

SUMMARY OF THE INVENTION

Accordingly, it is the primary object of the present invention to provide a structure of liquid container that has a casing and a cover assembly to integrate thereinside at least two bottles collecting and providing different liquids.

It is another object of the present invention to provide a structure of liquid container that applies a selecting mechanism to choose one of the inner bottles and further a pumping unit to pump out swiftly the specific liquid from the selected inner bottle through a liquid outlet of a cover.

In the present invention, the liquid container includes a casing, at least two inner bottles, at least one pumping unit, at least one turnable selecting mechanism, and a top cover. The casing includes a bottom cover, an annular sidewall located above the bottom cover, an opening located at the sidewall by opposing to the bottom cover, and a bottle-accommodating space located between the bottom cover and the sidewall. The at least two inner bottles are removably located in the bottle-accommodating space. Each of the at least two inner bottles includes an inner space for accommodating a liquid, and a draft tube assembly. The draft tube assembly includes a dip tube extending into the inner space by being close to an in-bottle bottom of the respective inner bottle, and an output tube connecting the dip tube by extending upward away the inner bottle from the inner space to a preset position out of the opening of the casing.

The at least one pumping unit is connected with the at least two inner bottles. When the at least one pumping unit is driven, a pumping force is generated to the liquid contained in one of the at least two inner bottles so as to pump out the liquid to the output tube through the dip tube of the draft tube assembly. The at least one turnable selecting mechanism, rotationally assembled to the casing, is co-moved with the at least one pumping unit. When the selecting mechanism is rotated, an action end of the selecting mechanism is turned to one of the at least two inner bottles, and this inner bottle corresponding to the action end is the aforesaid inner bottle to be pumped by the at least one pumping unit. The top cover, engaged onto the sidewall of the casing, further includes a liquid outlet thereon at a location respective to a tube opening of the output tube of the draft tube assembly for the inner bottle at least corresponding to the action end.

In one embodiment of the present invention, a number of the at least one pumping unit is equal to that of the at least two inner bottles, and each of the at least one pumping unit is located between the dip tube and the output tube of the draft tube assembly of the inner bottle; wherein, when the pumping unit is depressed, the pumping force is provided to the liquid of the respective inner bottle.

In one embodiment of the present invention, the selecting mechanism sleeves the at least one pumping unit and is co-moved with the top cover, and the top cover is rotationally assembled onto the sidewall of the casing; wherein, when the top cover is turned, the selecting mechanism is driven to rotate the action end to select one of the inner bottles.

In one embodiment of the present invention, the output tube of each the draft tube assembly is bent horizontally and directly toward the sidewall after extending over of the opening of the casing, the tube openings of the corresponding output tubes of different draft tube assemblies are led to respective locations at the sidewall, the tube openings of the individual output tubes of the respective draft tube assemblies are located at different positions at the top cover, the tube openings are largely located at the same level, and the liquid outlet is located at the top cover by being close to the sidewall and in correspondence with one of the tube openings.

All these objects are achieved by the structure of liquid container described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a structure of liquid container. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
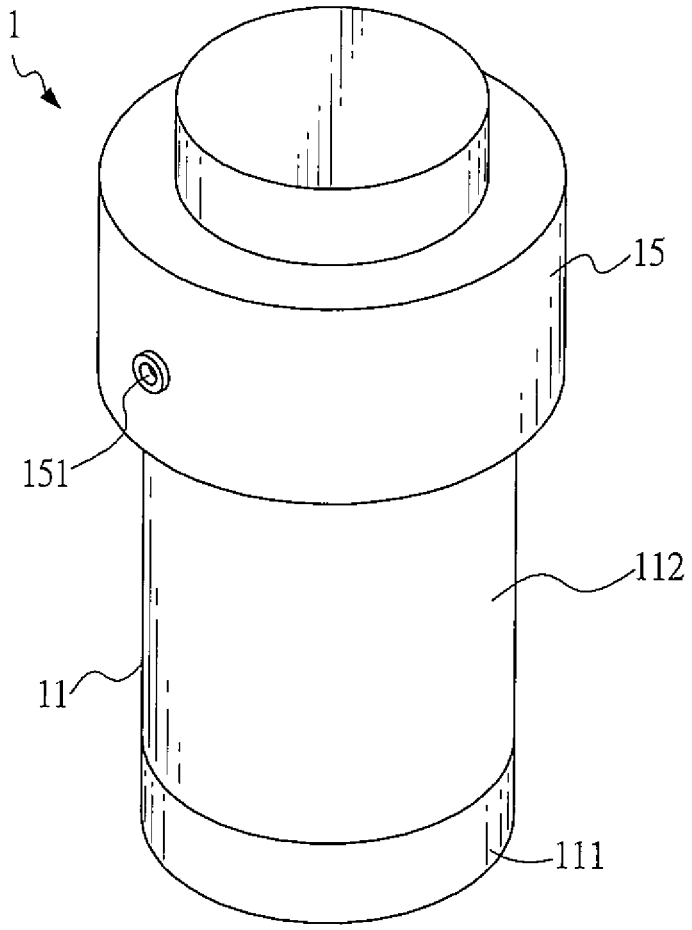
FIG. 1 is a schematically perspective view of a preferred liquid container in accordance with the present invention.
Figure 2:
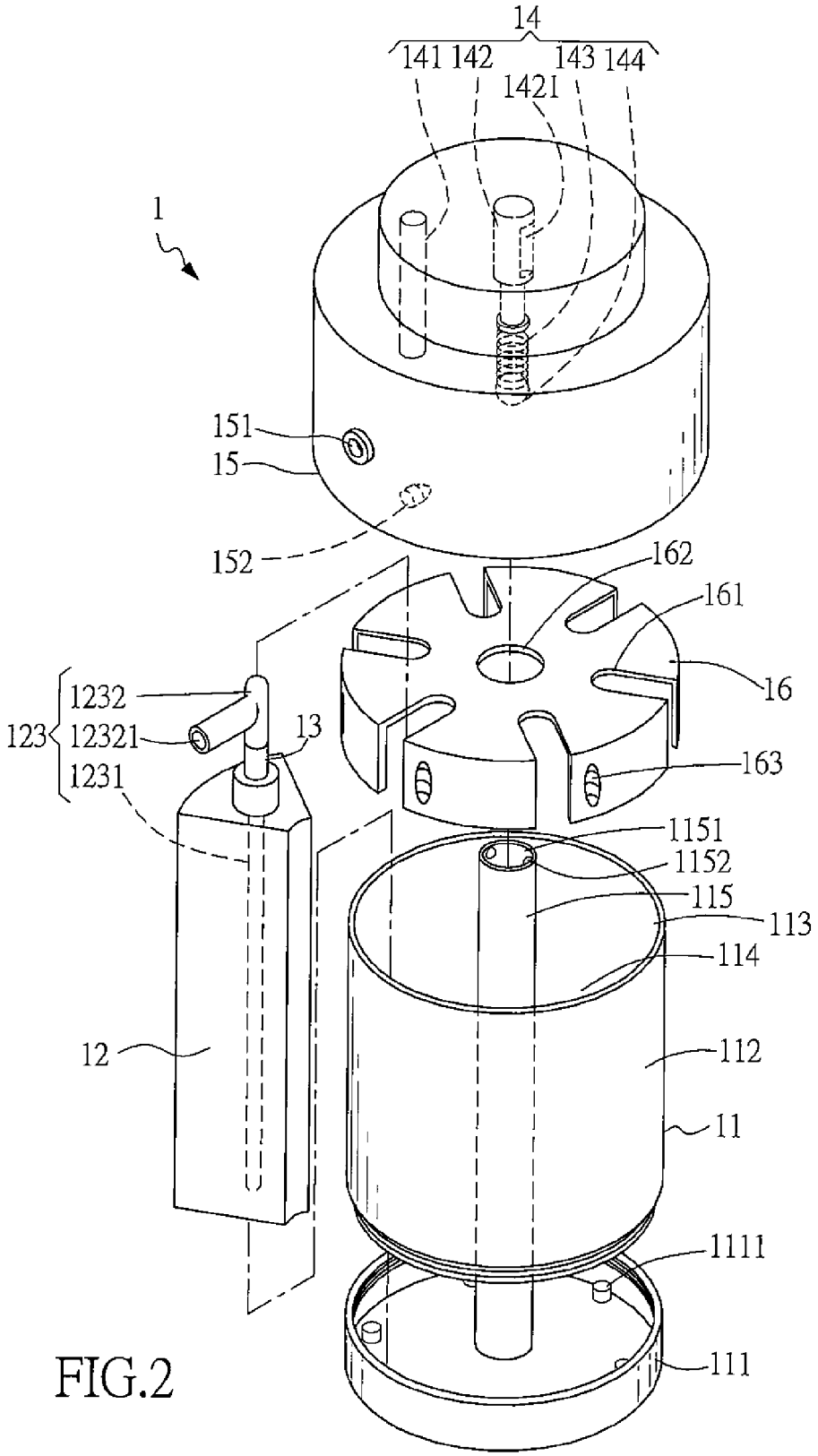
FIG. 2 is a schematically exploded view of FIG. 1.
Figure 3:
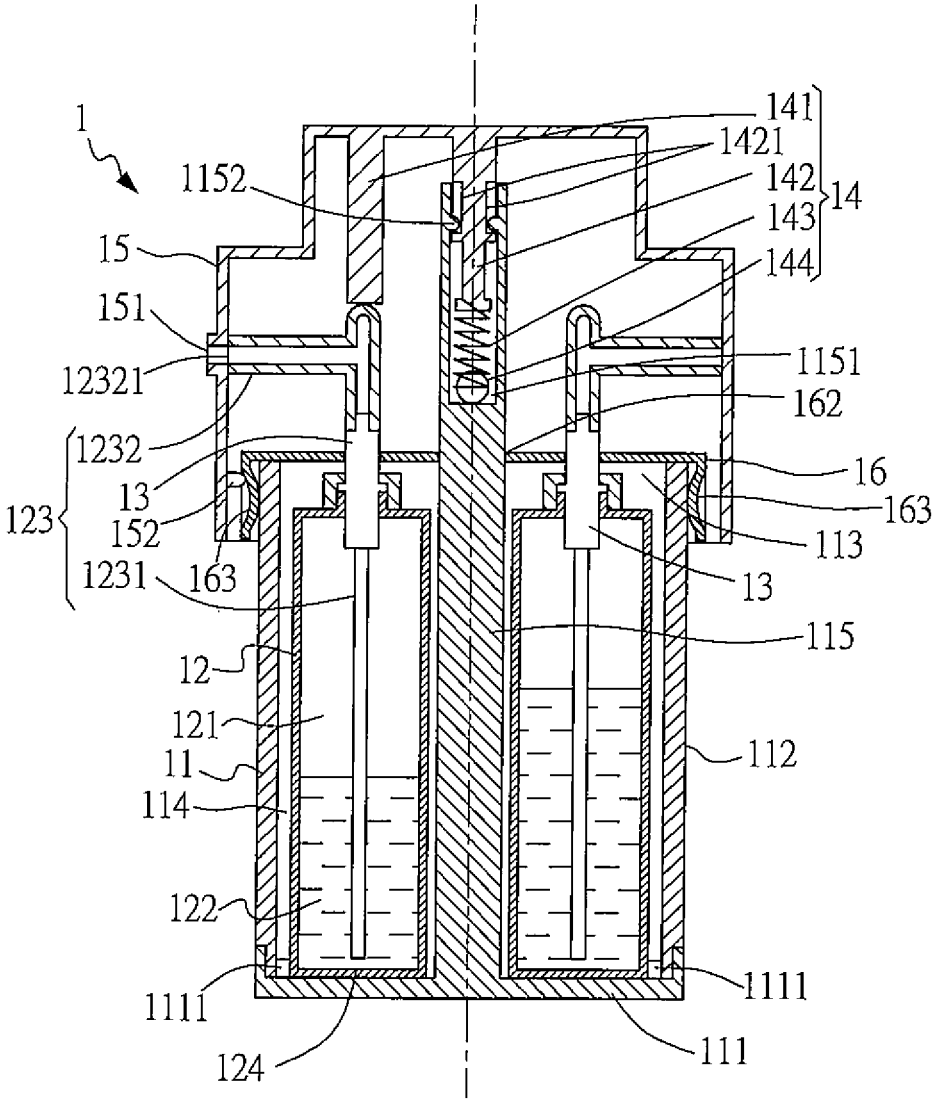
FIG. 3 is a schematically cross-sectional view of FIG. 1.

Refer now to FIG. 1 through FIG. 3; where FIG. 1 is a schematically perspective view of a preferred liquid container in accordance with the present invention, FIG. 2 is a schematically exploded view of FIG. 1, and FIG. 3 is a schematically cross-sectional view of FIG. 1. The liquid container 1 of the present invention includes a casing 11, at least two inner bottles 12, at least one pumping unit 13, at least one turnable selecting mechanism 14, a top cover 15 and a locating member 16.

The casing 11 includes a bottom cover 111, an annular sidewall 112 engaging the lower bottom cover 111, an opening 113 located at the sidewall 112 by opposing to the bottom cover 111, and a bottle-accommodating space 114 located between the bottom cover 111 and the sidewall 112. In addition, the bottom cover 111 engages the sidewall 112 in a removable manner (by screwing, for example but not limited thereto), and the bottom cover 111 is furnished with positioning pins 1111 located individually respective to the corresponding inner bottles 12 so as to position the inner bottle 12.

The at least two inner bottles 12 are removably located in the bottle-accommodating space 114. Each of the inner bottles 12 includes an inner space 121 for accommodating a liquid 122, and a draft tube assembly 123. The draft tube assembly 123 includes a dip tube 1231 extending into the inner space 121 by being close to an in-bottle bottom 124 of the inner bottle 12, and an output tube 1232 connecting the dip tube 1231 by extending upward away the inner bottle 12 from the inner space 121 to a preset position out of the opening 113 of the casing 11. In this preferred liquid container 1, with the bottom cover 111 to be separated from the sidewall 112, six said inner bottles 12, each of which is shaped as a circular sector, can be interference-fixed onto the bottom cover 111 by the corresponding positioning pins 1111, and then can be sent into the bottle-accommodating space 114 through the end of the casing 11 opposing to the opening 113.

The at least one pumping unit 13 are connected with these inner bottles 12. When the at least one pumping unit 13 is driven, a pumping force would be generated to the liquid 122 contained in one of the inner bottles 12 so as to pump out the liquid 122 to the output tube 1232 through the dip tube 1231 of the draft tube assembly 123. The number of the at least one pumping unit 13 shall be the same as that of the inner bottles 12, and each of the pumping units 13 is located between the dip tube 1231 and the output tube 1232 of the corresponding draft tube assembly 123 of the respective inner bottle 12. When the pumping unit 13 is depressed by an external force, the pumping unit 13 would provide a corresponding pumping force to the liquid 122 inside the inner bottle 12. Since the pumping unit 13 can adopt any conventional member already in the marketplace and is not one of major features of the present invention, thus details thereabout would be omitted herein.

The selecting mechanism 14, sleeving the pumping units 13 and being co-moved with the top cover 15, is rotationally assembled to the casing 11. When the selecting, mechanism 14 is rotated by another foreign force, an action end 141 of the selecting mechanism 14 would be turned to one of the inner bottles 12 and thus ready to activate the pumping unit 13 corresponding to the selected inner bottle 12. Namely, when the foreign force rotates the top cover 15, the selecting mechanism 14 would be rotated synchronously so as to have the action end 141 to be turned to a target inner bottle 12.

The turnable selecting mechanism 14 further includes a locating pin 142 located at a center inner the top cover 15, and an elastic member 143 having a spherical member 144 is fixed to an end portion of the locating pin 142. By having the spherical member 144 at one end of the elastic member 143 to be located in a central cavity 1151 of a central post 115 inside the casing 11, the selecting mechanism 14 can thus be elastically mounted with respect to the casing 11, with the action end 141 to be located at a preset position on an interior surface of the top cover 15. The central post 115 further includes two opposing teeth 1152 in the central cavity 1151. When the central post 115 sleeves the locating pin 142, these two teeth 1152 would engage two corresponding sliding slots 1421 on the locating pin 142, such that the top cover 15 can undergo an elastic linear movement along these two sliding slots 1421 via the elastic member 143. In the present invention, the elastic member 143 can be a spring.

The top cover 15 can be engaged onto the sidewall 112 of the casing 11 in a rotation manner. The top cover 15 further has a liquid outlet 151 thereon at a location respective to a tube opening 12321 of the output tube 1232 of the draft tube assembly 123 for the inner bottle 12 at least corresponding to the action end 141.

Namely, the output tube 1232 of each the draft tube assembly 123 is bent horizontally and directly toward the sidewall 112 after extending out of the opening 113 of the casing 11. Also, the tube openings 12321 of the corresponding output tubes 1232 of different draft tube assemblies 123 would be led to respective locations at the sidewall 112. Preferably, these tube openings 12321 of these different draft tube assemblies 123 are largely at the same level. The liquid outlet 151 constructed at the top cover 15 by being close to the sidewall 112 can take care one of the tube openings 12321 at a time. Hence, in the liquid container of the present invention, the specific liquid 122 contained in the particular inner bottle 12 is provided through its own output tube 1232 and tube opening 12321 of the corresponding inner bottle 12. Namely, no two liquids 122 from different inner bottles 12 can be provided by a common output tube 1232 and a common tube opening 12321. Thereupon, no inter-contamination is possible during the pumping of different liquids 122 from different inner bottles 12. Thus, for instance, the user can store a skincare lotion in one inner bottle 12 and a shampoo in another inner bottle 12, and he/she doesn't need to worry if the skincare lotion could be polluted by the shampoo.

The locating member 16, covering and being mounted over the opening 113 of the casing 11, includes a plurality of installation caves 161 for positioning the respective inner bottles 12, a central hole 162 for the central post 115 to penetrate therethrough, and a plurality of position grooves 163 for elastically notching an elastic bump 152 furnished to a preset position on an interior wall of the top cover 15. Namely, the locating member 16 is to anchor at least two inner bottles 12 in the bottle-accommodating space 114 of the casing 11, so that, when the top cover 15 is turned to drive the selecting mechanism 14 to select one of the inner bottles 12, these inner bottles 12 can be firmly held in the bottle-accommodating space 114 of the casing 11 by the locating member 16, without being driven off by the top cover 16. In addition, through the rotation of the selecting mechanism 14 by the top cover 15, the elastic bump 152 would be elastically notched into one of the position grooves 163, and a corresponding "kluck" noise indicates that the selected inner bottle 12 has been reached. Namely, the tube opening 12321 of the selected inner bottle 12 has been aligned with the liquid outlet 151 of the top cover 15, such that a further depression upon the top cover 15 would drive the elastic bump 152 to undergo a linear motion along the position groove 163 so as to squeeze out the liquid 122 from the selected inner bottle 12.

In the liquid container 1 of the present invention, a plurality of the inner bottles 12 containing different liquids 122 are firstly collected into the bottle-accommodating space 114 of the casing 11, and then the locating member 16 is applied to fix the inner bottles 12 together inside the casing 11. By providing the elastic member 143 and the spherical member 144 at the end portion of the locating pin 142 of the selecting mechanism 14 to engage elastically thereinside the central installation groove 1151 at a top portion of the central post 115 of the casing 11, the top cover 15 can then be located elastically at the casing 11, and can rotate to drive the selecting mechanism 14 to select one specific inner bottle 12. Thereupon, while in depressing the top cover 15, a spring energy can be stored, and a stroke for the action end of the selecting mechanism 14 to squeeze the output tube 1232 of the pumping unit 13 at the corresponding inner bottle 12 can be provided. Thus, the liquid outlet 151 of the top cover 15 and the tube opening 1231 of the output tube 1232 at the selected inner bottle 12 can move up and down synchronously. Thereby, the liquid 122 in the selected inner bottle 12 can be squeezed out from the outlet 151 of the top cover 15 through the dip tube 1231 and the output tube 1232 of the draft tube assembly 123.

In the following embodiments of the present invention, since a large portion of elements are resembled or similar at least to those in the aforesaid preferred embodiment, thus details for those common and similar elements would be omitted herein. In addition, those common elements would be assigned by the same names and numbers. However, to those similar elements, though the same names are still assigned, yet the numbers would be formed by the same number but tailed by a letter, "a" for example.

Figure 4:
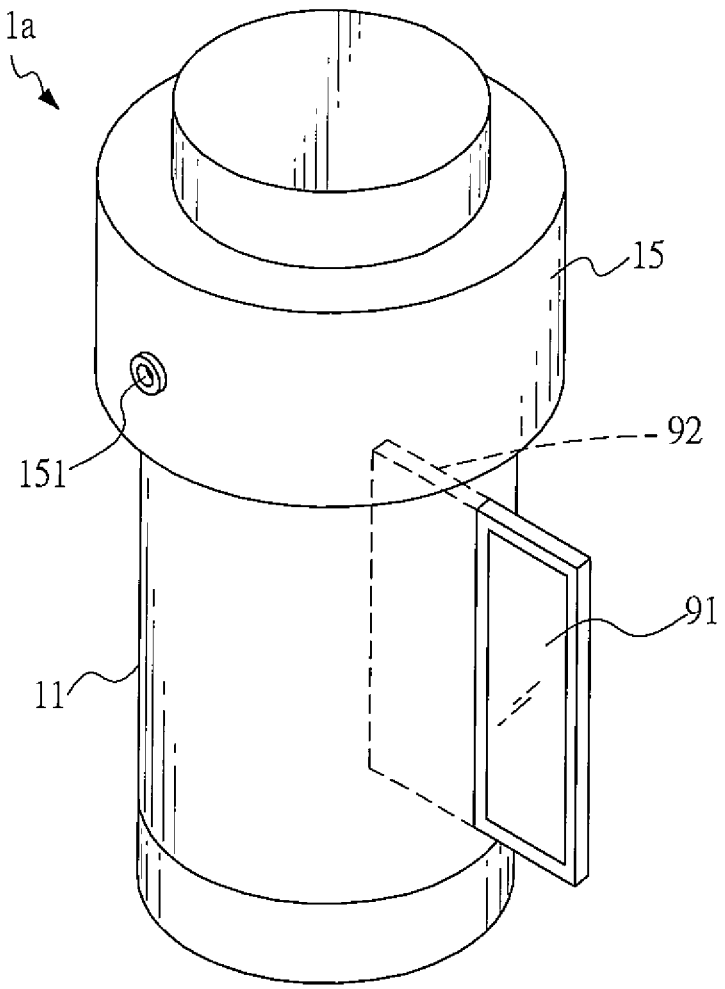
FIG. 4 is a schematically perspective view of a first embodiment of the liquid container in accordance with the present invention.

Referring now to FIG. 4, a schematically perspective view of a first embodiment of the liquid container in accordance with the present invention is shown. Since the first embodiment of the liquid container of FIG. 4 is largely resembled to the preferred liquid container of FIG. 1~FIG. 3, thus descriptions upon common elements and structures would be omitted herein. In this embodiment, a difference between this liquid container and the aforesaid preferred liquid container is that the first embodiment of the liquid container 1*a* includes an installation groove 91 located at the sidewall 112 of the casing 11. A mirror 92 can be inserted in the installation groove 91 in a draw-able manner. Namely, while in usage, the mirror 92 can be pulled out from the installation groove 91. On the other hand, for storage, the mirror 92 can be pushed into the installation groove 91. Namely, the entire mirror 92 can be retrieved into the casing 11 completely, and extends arbitrarily out of casing 11 for user's makeup.

Figure 5:
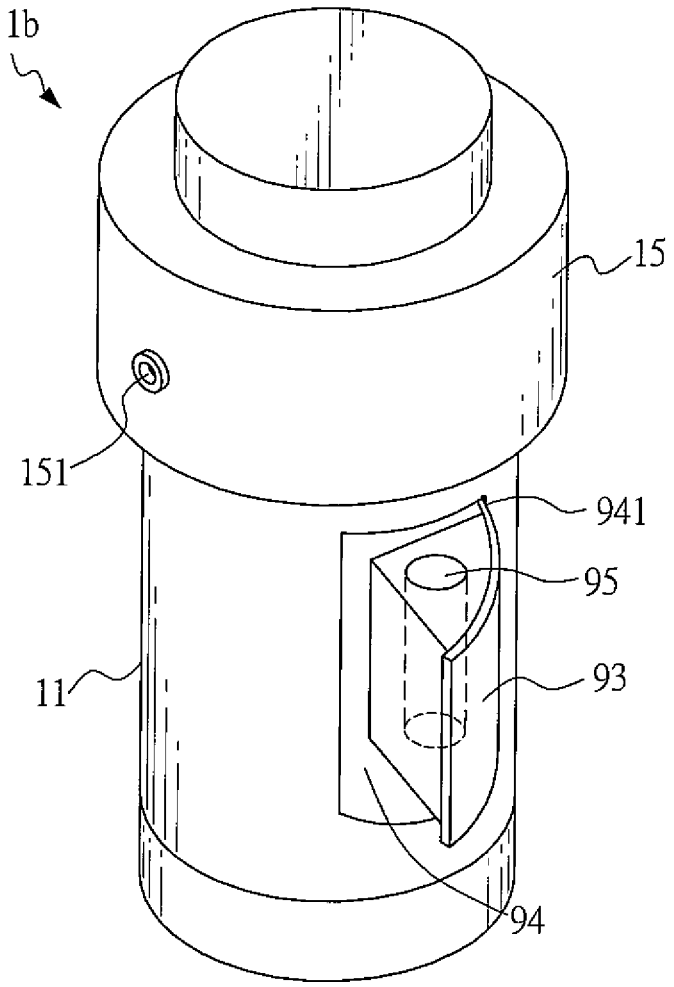
FIG. 5 is a schematically perspective view of a second embodiment of the liquid container in accordance with the present invention.

Referring now to FIG. 5, a schematically perspective view of a second embodiment of the liquid container in accordance with the present invention is shown. Since the second embodiment of the liquid container of FIG. 5 is largely resembled to the preferred liquid container of FIG. 1~FIG. 3, thus descriptions upon common elements and structures would be omitted herein. In this embodiment, a difference between this liquid container and the aforesaid preferred liquid container is that the second embodiment of the liquid container 1*b* includes at least one pivotal door 93 and at least one installation opening 94 at the sidewall 112 of the casing 11. The number of the installation openings 94 is preferably equal to that of the pivotal doors 93. In addition, at least one accommodation space 95 is located behind the pivotal door 93. The pivotal door 93, pivotally connected to a lateral side 941 of the installation opening 94, is to close or open the installation opening 94. While in closing the pivotal door 93, the accommodation space 95 is located within the installation opening 94. Namely, the pivotal door 93, pivotally engaged at the sidewall 112, can be swung out from the installation opening 94, and the accommodation space 95 located behind the pivotal door 93 can be used to store makeup accessories such as eyebrow pencils, lipsticks, eyelash brushes, cotton swabs and so on. In addition, the pivotal door 93 can be turned into the installation opening 94 for collecting these makeup accessories into the installation opening 94, i.e. inside the casing 11, for convenient storage and carrying.

Figure 6:
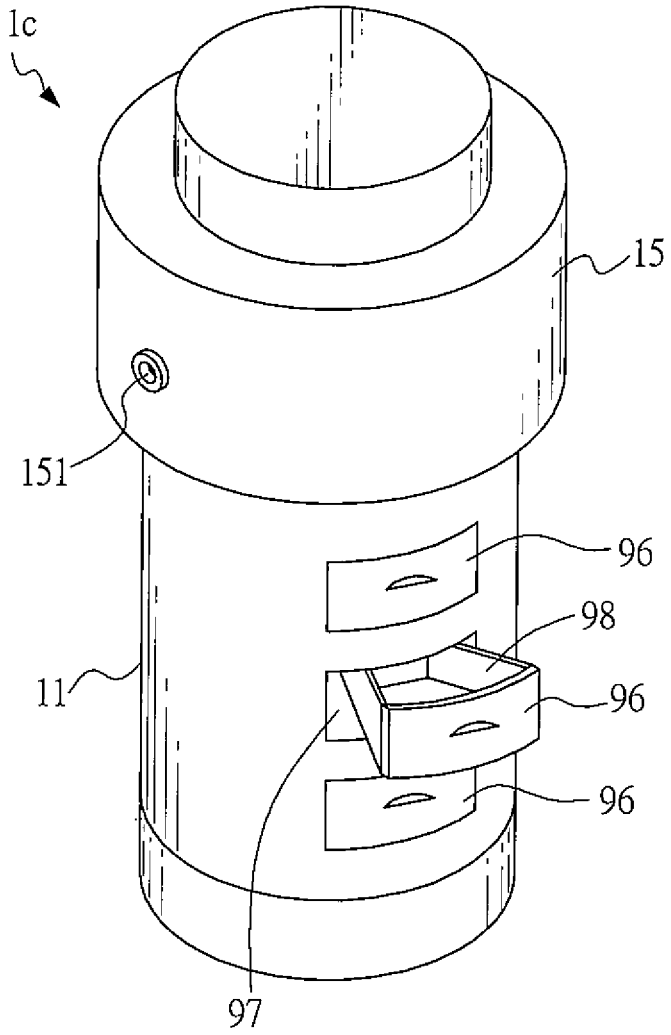
FIG. 6 is a schematically perspective view of a third embodiment of the liquid container in accordance with the present invention.

Referring now to FIG. 6, a schematically perspective view of a third embodiment of the liquid container in accordance with the present invention is shown. Since the third embodiment of the liquid container of FIG. 6 is largely resembled to the preferred liquid container of FIG. 1~FIG. 3, thus descriptions upon common elements and structures would be omitted herein. In this embodiment, a difference between this liquid container and the aforesaid preferred liquid container is that the third embodiment of the liquid container 1*c* includes at least one drawer 96 and at least one installation cave 97 at the sidewall 112 of the casing 11. The number of the installation caves 97 is preferably equal to that of the drawers 96, and each of the drawers 96 is furnished with an accommodation space 98 located therebehind. Each of the drawers 96 can be close or opened within the installation cave 97. While the drawer 96 is close, the accommodation space 98 is retrieved into the installation cave 97; i.e. the accommodation space 98 is merged into the casing 11 so as to collect and sort various makeup accessories inside the accommodation space 98, such as fake eyelashes, face-blotting papers and so on. Thereupon, these makeup accessories can be carried conveniently.

Figure 7A:
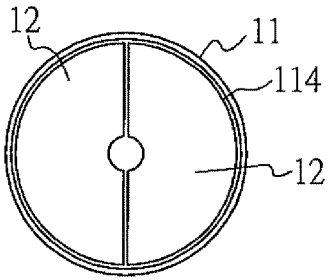
FIG. 7A~FIG. 7F demonstrate schematically various arrangement embodiments of the inner bottles within the liquid container in accordance with the present invention.
Figure 7B:
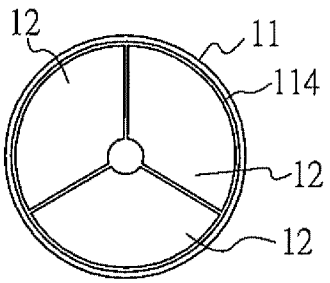
Figure 7C:
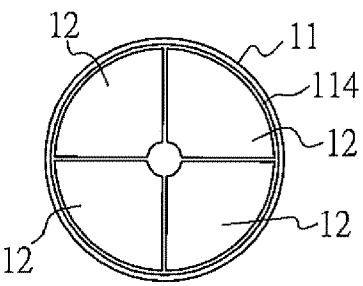
Figure 7D:
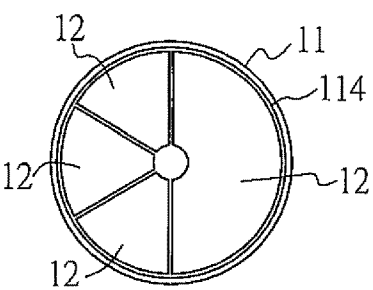
Figure 7E:
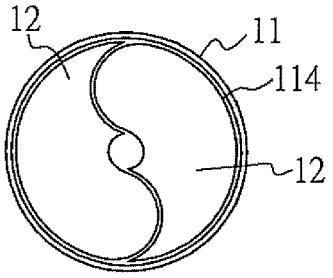
Figure 7F:
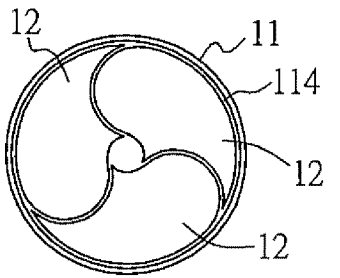

Referring now to FIG. 7A~FIG. 7F, various arrangement embodiments of the inner bottles within the liquid container in accordance with the present invention are schematically demonstrated. As shown in FIG. 7A, the inner bottles 12 to be received in the bottle-accommodating space 114 of the casing 11 can be two cylindrical bottles, each of which has a cross section of a ½-circle sector. As shown in FIG. 7B, the inner bottles 12 to be received in the bottle-accommodating space 114 of the casing 11 can be three cylindrical bottles, each of which has a cross section of a ⅓-circle sector. As shown in FIG. 7C, the inner bottles 12 to be received in the bottle-accommodating space 114 of the casing 11 can be four cylindrical bottles, each of which has a cross section of a ¼-circle sector. As shown in FIG. 7D, the inner bottles 12 to be received in the bottle-accommodating space 114 of the casing 11 can be four cylindrical bottles, one having a cross section of a ½-circle sector and each of another three having a cross section of a ⅙-circle sector. As shown in FIG. 7E, the inner bottles 1 to be received in the bottle-accommodating space 114 of the casing 11 can be two cylindrical bottles, each of which has a cross section of a ½-circle vortex sector. As shown in FIG. 7F, the inner bottles 12 to be received in the bottle-accommodating space 114 of the casing 11 can be three cylindrical bottles, each of which has a cross section of a ⅓-circle vortex sector.

Figure 8:
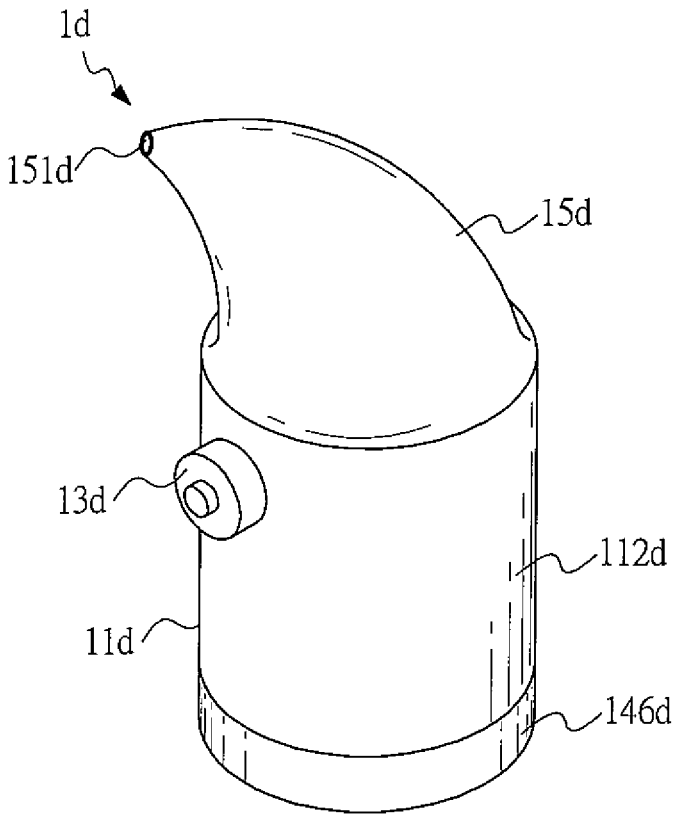
FIG. 8 is a schematically perspective view of a fourth embodiment of the liquid container in accordance with the present invention.
Figure 9:
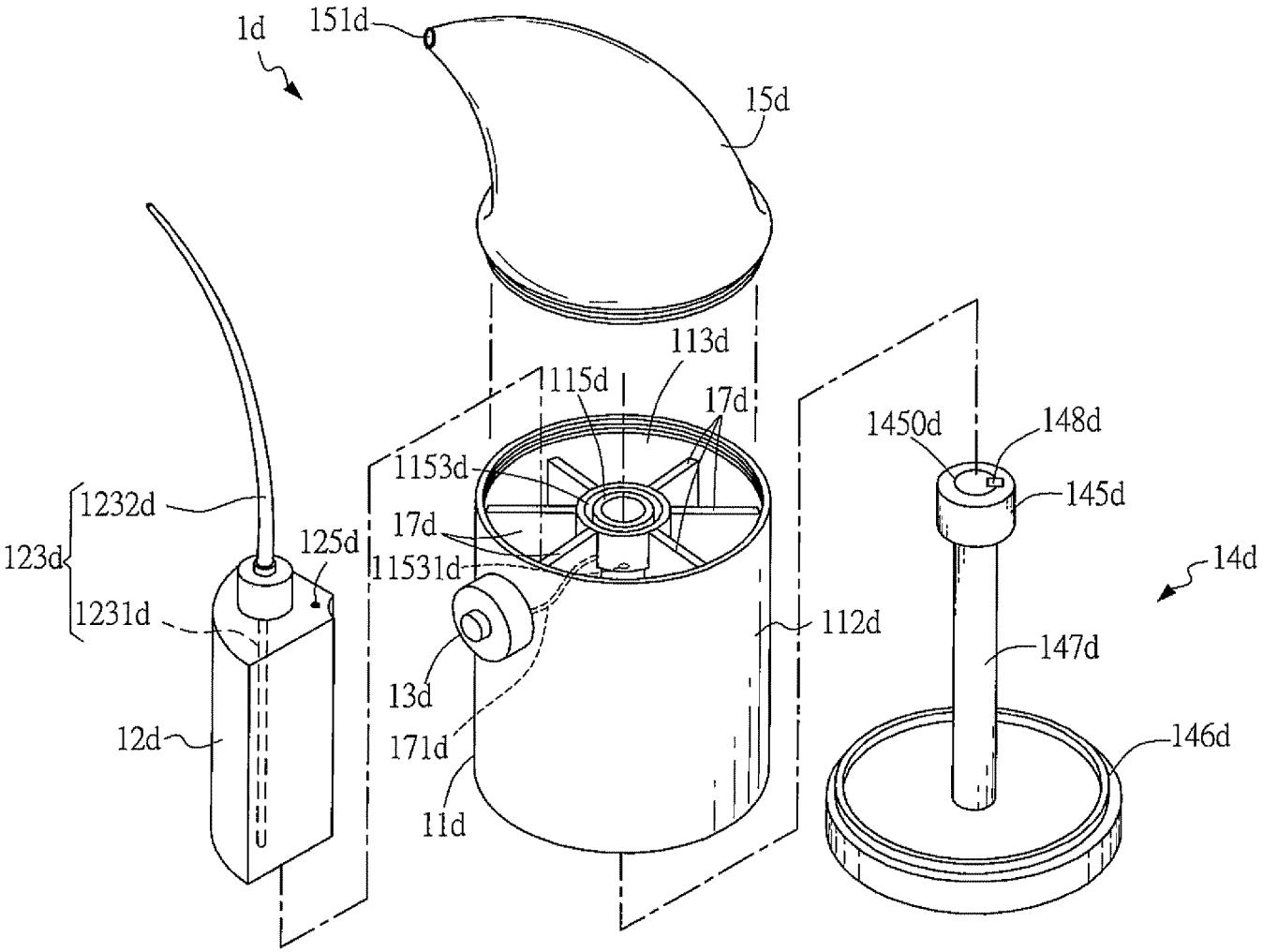
FIG. 9 is a schematically exploded view of FIG. 8.
Figure 10:
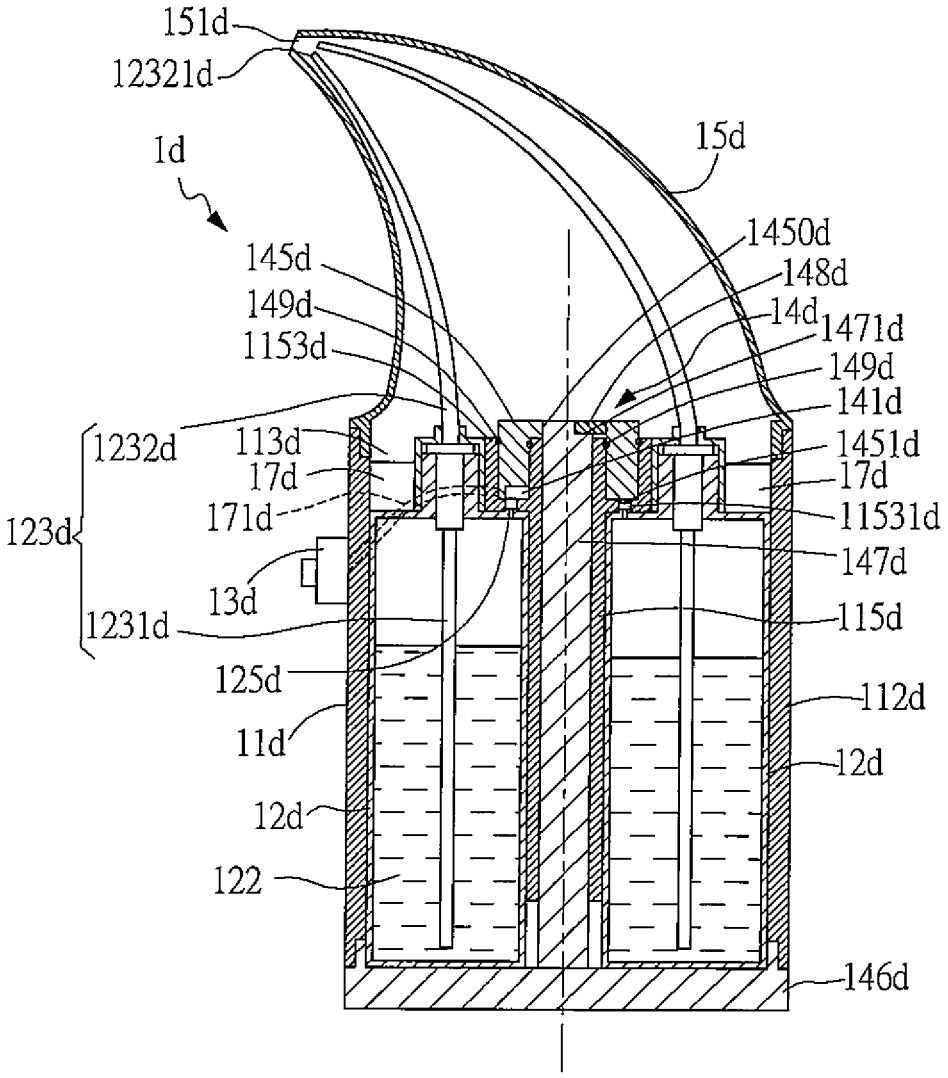
FIG. 10 is a schematically cross-sectional view of FIG. 8.
Figure 11:
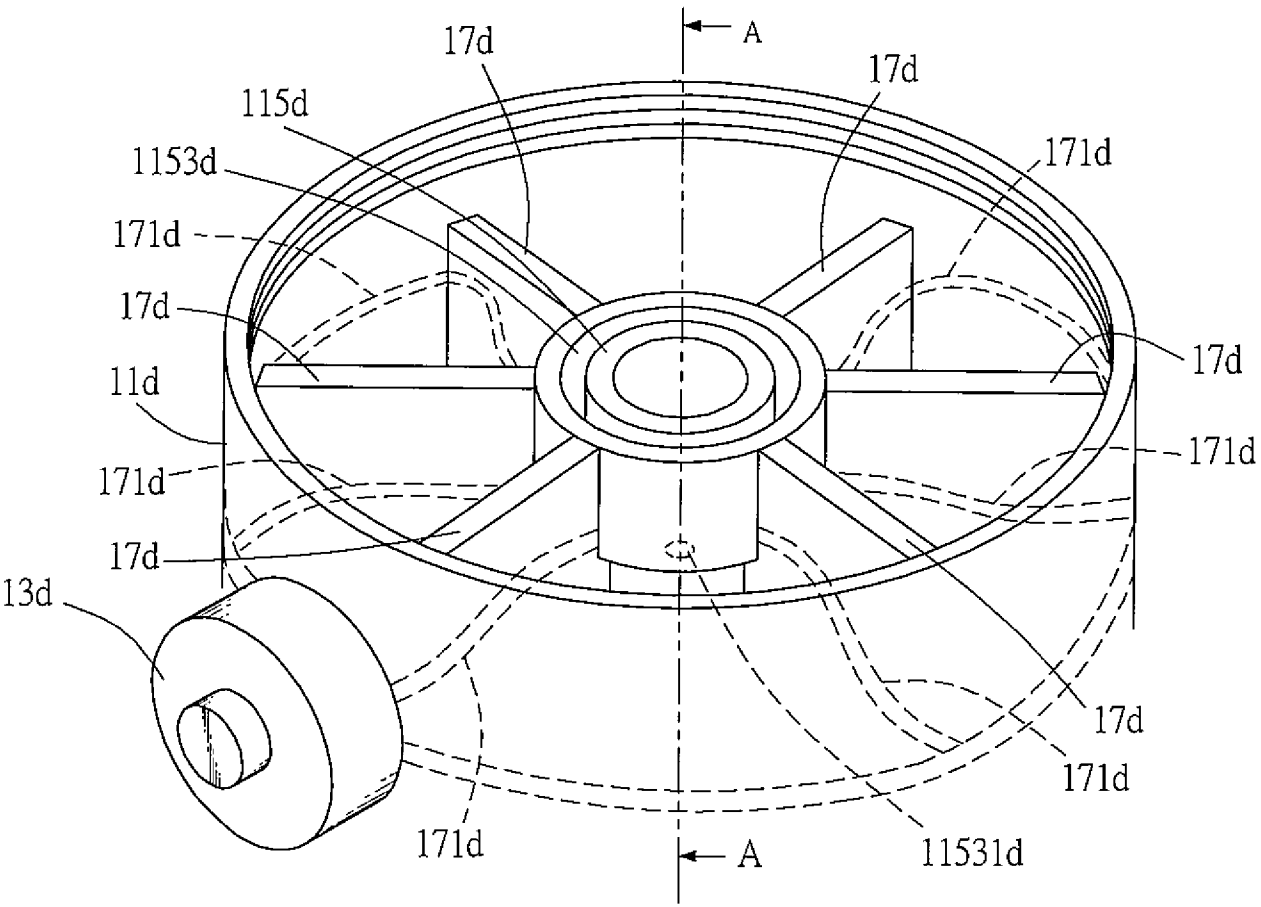
FIG. 11 is a schematically perspective enlarged view of a portion of the casing of FIG. 9.
Figure 12:
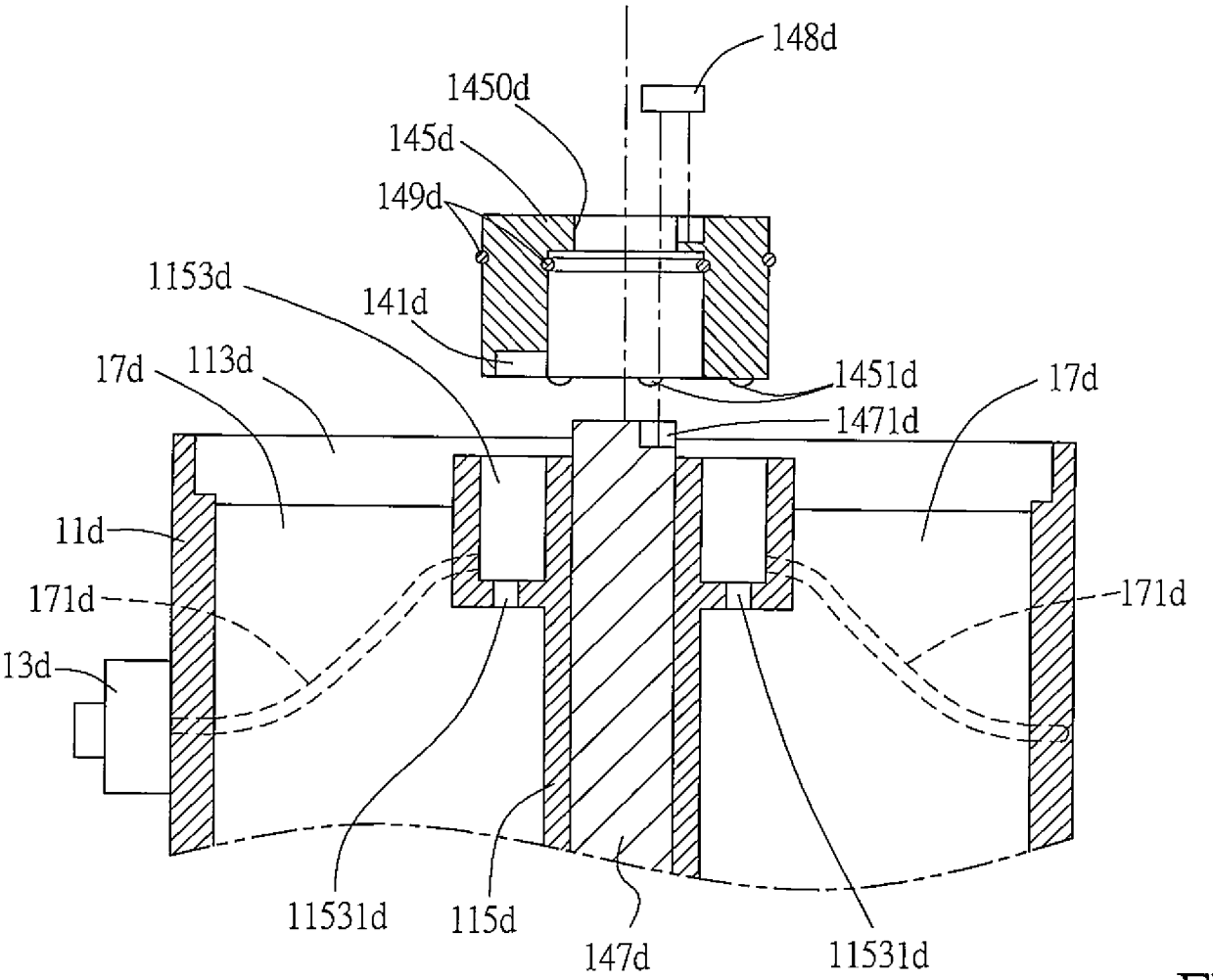
FIG. 12 is a schematically cross-sectional view of FIG. 11 along line A-A.

Refer now to FIG. 8 through FIG. 12; where FIG. 8 is a schematically perspective view of a fourth embodiment of the liquid container in accordance with the present invention, FIG. 9 is a schematically exploded view of FIG. 8, FIG. 10 is a schematically cross-sectional view of FIG. 8, FIG. 11 is a schematically perspective enlarged view of a portion of the casing of FIG. 9, and FIG. 12 is a schematically cross-sectional view of FIG. 11 along line A-A. Since the fourth embodiment of the liquid container of FIG. 8 is largely resembled to the preferred liquid container of FIG. 1~FIG. 3, thus descriptions upon common elements and structures would be omitted herein. In this embodiment, a difference between this liquid container and the aforesaid preferred liquid container is that the at least one pumping unit 13*d* of the fourth embodiment of the liquid container 1*d* is furnished to one of the casing 11*d* and the top cover 15*d*. In particular, as shown in the figures, the pumping unit 13*d* of the fourth embodiment is located at the casing 11*d*, formed as a push-button micro pump.

In addition, a plurality of rib elements 17*d* arranged into a radial array, are to bridge the interior surface of the sidewall 112*d* and a hollow central post 115*d* extending along an axial central line of the casing 11*d*. Each of the rib elements 17*d* is further furnished with a ventilation duct 171*d*. When the pumping unit 13*d* is depressed, an air pressure would be generated and provided to one of the inner bottles 12*d* via the corresponding ventilation duct 171*d*, such that the liquid 122 inside the selected inner bottle 12*d* can thus be pumped out to the output tube 1232*d* through the dip tube 1231*d* of the corresponding draft tube assembly 123*d* by the air pressure.

Each of the inner bottles 12*d* has an air-intake hole 125*d*, the selecting mechanism 14*d* includes a liquid-guiding member 145*d*, and the action end 141*d* formed as an air inlet is located at the liquid-guiding member 145*d*. The liquid-guiding member 145*d* is connected spatially with the ventilation duct 171*d*, so that the air pressure from the pumping unit 13*d* can be guided to the air inlet 141*d* through the liquid-guiding member 145*d*. When the selecting mechanism 14*d* is turned by another forcing, the position of the air inlet 141*d* would be shifted to one of the air-intake holes 125*d* of the corresponding inner bottles 12*d*.

The selecting mechanism 14*d* further includes a rotatable base member 146*d* and a center pillar 147*d* engaged at a center of the base member 146*d*. The base member 146*d* is removably connected to a bottom end of the casing 11*d*. The center pillar 147*d* penetrates the hollow central post 115*d* extending axially along a center line of the casing 11*d*, and the liquid-guiding member 145*d* formed as a ring has a central through hole 1450*d*. The liquid-guiding member 145*d* is fixed to a top end of the center pillar 147*d* via a fixation pair of a key 148*d* and a key slot 1471*d* at the top end of the center pillar 147*d*. Further, the liquid-guiding member 145*d* is inserted into an annular groove 1153*d* at the top end of the central post 115*d*, such that the base member 146*d* and the liquid-guiding member 145*d* can rotate synchronously. In addition, two gasket rings 149*d* are furnished individually to a periphery and an interior wall of the liquid-guiding member 145*d*, respectively. As long as the liquid-guiding member 145*d* is inserted into the annular groove 1153*d* an airtight effect can thus be obtained.

The annular groove 1153*d* is spatially connected to the pumping unit 13*d* through the ventilation duct 171*d*, and the annular groove 1153*d* further has at least one conducting hole 11531*d* located thereinside. One open end of the conducting hole 11531*d* is located in correspondence with the air-intake hole 125*d* of the inner bottle 12*d*, while another open end thereof is located in correspondence with at least one bump point 1451*d* on the annular periphery of the liquid-guiding member 145*d*. When the air inlet 141*d* is connected with the air-intake hole 125*d* of one of the inner bottles 12, these bump points 1451*d* would be right there to block the air-intake holes 125*d* of the other inner bottles 12*d*. Namely, when each of the inner bottles 12*d* is sent into the casing 11*d* by being located between two rib elements 17*d*, the air-intake hole 125*d* at the corresponding inner bottle 12*d* would connect the conducting hole 11531*d* located under the annular groove 1153*d* at the top end of the central post 115*d*, such that selective conduction for the inner bottles 12*d* can be performed by the liquid-guiding member 145*d* through the conducting holes 11531*d* and the ventilation ducts 171 inside the corresponding rib elements 17*d*.

In the fourth embodiment of the present invention, after the output tube 1232*d* of each the draft tube assembly 123*d* extends over the opening 113*d* of the casing 11*d*, it further extends to the liquid outlet 151*d* of the top cover 15*d*, so that these tube openings 12321*d* of the draft tube assemblies 123*d* are all directed to the liquid outlet 151*d* of the top cover 15*d*.

Namely, while the fourth embodiment of the liquid container 1*d* is in use, the base member 146*d* of the selecting mechanism 14*d* is firstly turned to select the inner bottle 12*d* to be squeezed. At this time, the base member 146*d* can move synchronously the liquid-guiding member 145*d* engaged at the top end of the center pillar 147*d*. Then, the air inlet 141*d* on the liquid-guiding member 145*d* would right align with the conducting hole 11531*d* in the annular groove 1153*d* and the air-intake hole 125*d* of the selected inner bottle 12*d*, while the air-intake holes 125*d* of the other inner bottles 12*d* would be blocked by having the bump points 1451*d* on the liquid-guiding member 145*d* to seal the other conducting holes 11531*d* in the annular groove 1153*d*. Further, the pumping unit 13*d* is applied to send the air pressure to the selected inner bottle 12*d* via the ventilation duct 171*d*, so that the liquid 122 contained in the inner bottle 12*d* would be pumped to the liquid outlet 151*d* via the draft tube assembly 123*d*.

Figure 13:
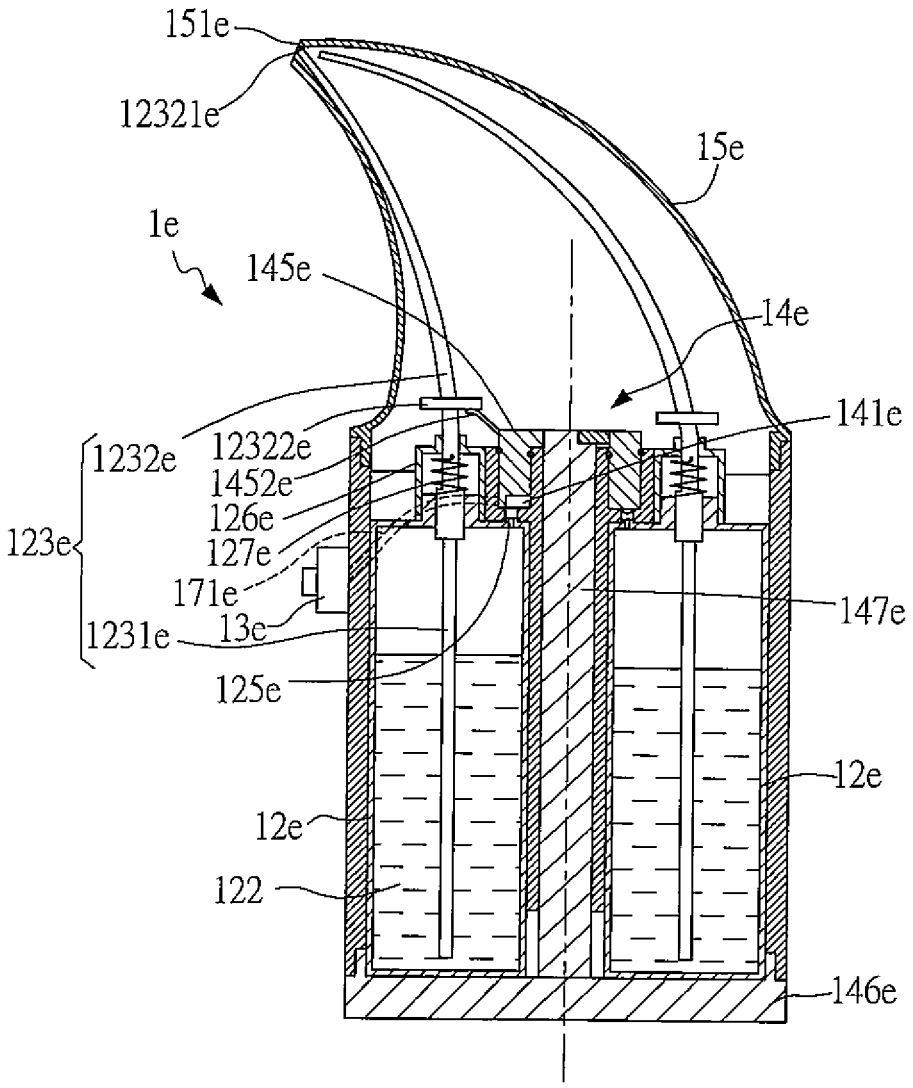
FIG. 13 is a schematically cross-sectional view of a fifth embodiment of the liquid container in accordance with the present invention.
Figure 14B:
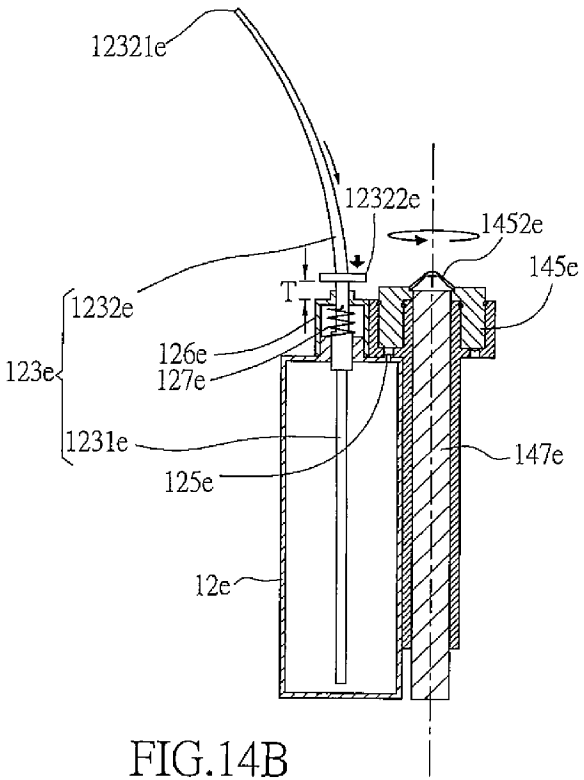
FIG. 14A and FIG. 14B demonstrate schematically two states of the output tube of FIG. 13.
Figure 14A:
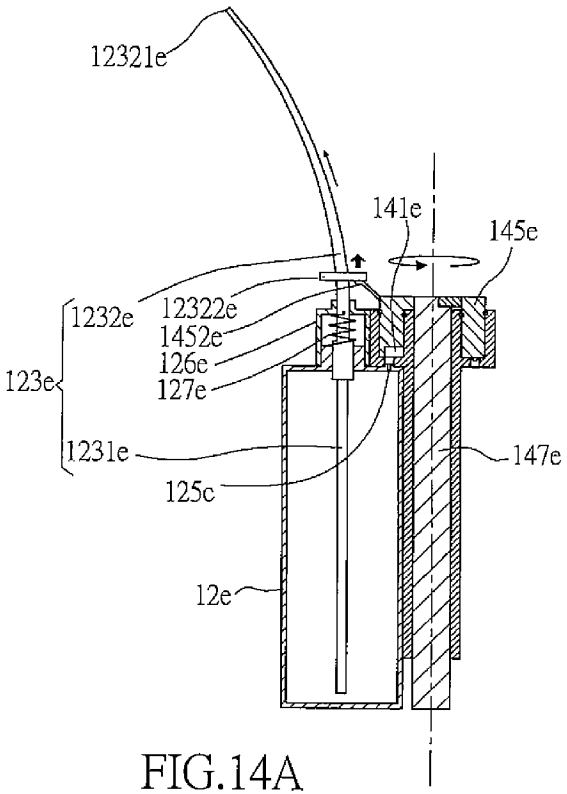
Figure 16:
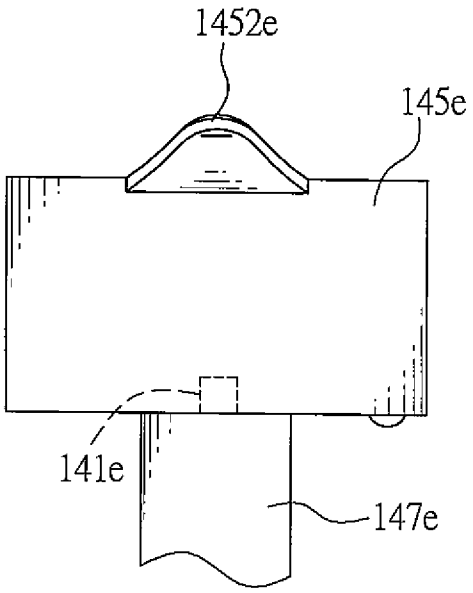
FIG. 16 is a left side view of FIG. 15.
Figure 15:
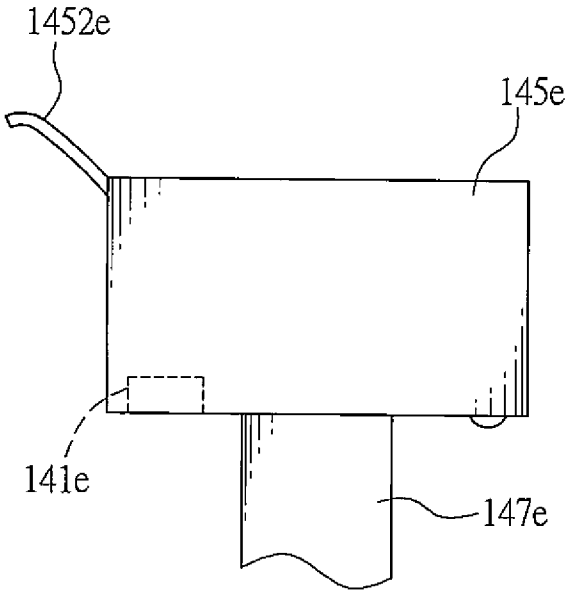
FIG. 15 is a schematically front view of the liquid-guiding member of FIG. 13.

Refer now to FIG. 13 through FIG. 16; where FIG. 13 is a schematically cross-sectional view of a fifth embodiment of the liquid container in accordance with the present invention, FIG. 14A and FIG. 14B demonstrate schematically two states of the output tube of FIG. 13, FIG. 15 is a schematically front view of the liquid-guiding member of FIG. 13, and FIG. 16 is a left side view of FIG. 15. Since the fifth embodiment of the liquid container of FIG. 13 is largely resembled to the fourth embodiment of the liquid container of FIG. 8~FIG. 12, thus descriptions upon common elements and structures would be omitted herein. A difference between the fifth embodiment of the liquid container and the aforesaid embodiments of the present invention is that, in the fifth embodiment of the liquid container 1*e*, the inner bottle 12*e* further includes an inner-bottle cap 126*e* and a restoring spring 127*e*. The inner-bottle cap 126*e* drives the restoring spring 127*e* to elastically fix the draft tube assembly 123*e* in the inner bottle 12*e*. Namely, one end of the restoring spring 127*e* is fixed to the inner bottle 12*e*, while another end thereof is fixed to the dip tube 1231*e*. In addition, a collar ring 12322*e* is furnished to the output tube 1232*e*, and the collar ring 12322*e* is spaced from the inner-bottle cap 126*e* at least by a preset distance T (as shown in FIG. 14B).

A spring plate 1452*e* is provided to the annular periphery of the liquid-guiding member 145*e* at the top end of the center pillar 147*e*. The spring plate 1452*e* is bent to an arc shape having a tip higher than the liquid-guiding member 145*e* by a predetermined distance, and located at a position respective to the air inlet 141*e*. When the air inlet 141*e* is in correspondence with the air-intake hole 125*e* of one of the inner bottles 12*e*, the spring plate 1452*e* would enter the space defining the preset distance T between the collar ring 12322*e* and the inner-bottle cap 126*e* so as to push the collar ring 12322*e* upward by a predetermined distance, such that the tube opening 12321*e* of the output tube 1232*e* would be further close to or over the liquid outlet 151*e* of the top cover 15*e*. When the spring plate 1452*e* is turned away from the collar ring 12322*e*, the draft tube assembly 123*e* would apply the restoring spring 127*e* to gain back the preset distance T to space the collar ring 12322*e* and the inner-bottle cap 126*e*, and to retrieve the tube opening 12321*e* back into the top cover 15*e* at a place away from the liquid outlet 151*e*.

Namely, while the fifth embodiment of the liquid container 1*e* is in use, the base member 146*e* of the selecting mechanism 14*e* is firstly turned to select the inner bottle 12*e* to be squeezed. At this time, the base member 146*e* can move synchronously the liquid-guiding member 145*e* engaged at the top end of the center pillar 147*e*, so that the air inlet 141*e* on the liquid-guiding member 145*e* can be right aligned with the air-intake hole 125*e* of the inner bottle 12*e*. Thus, the spring plate 1452*e* on the liquid-guiding member 145*e* would enter the space defining the preset distance T for spacing the collar ring 12322*e* from the inner-bottle cap 126*e*, such that the collar ring 12322*e* would be pushed upward by a predetermined distance so as to have the tube opening 12321*e* of the output tube 1232*e* further close to or over the liquid outlet 151*e* of the top cover 15*e*. Further, the pumping unit 13*e* is utilized to pump the air pressure into the selected inner bottle 12*e* via the ventilation duct 171*e*, and then the liquid 122 contained in the inner bottle 12*e* would be pumped out to the liquid outlet 151*e* through the draft tube assembly 123*e*.

Figure 17:
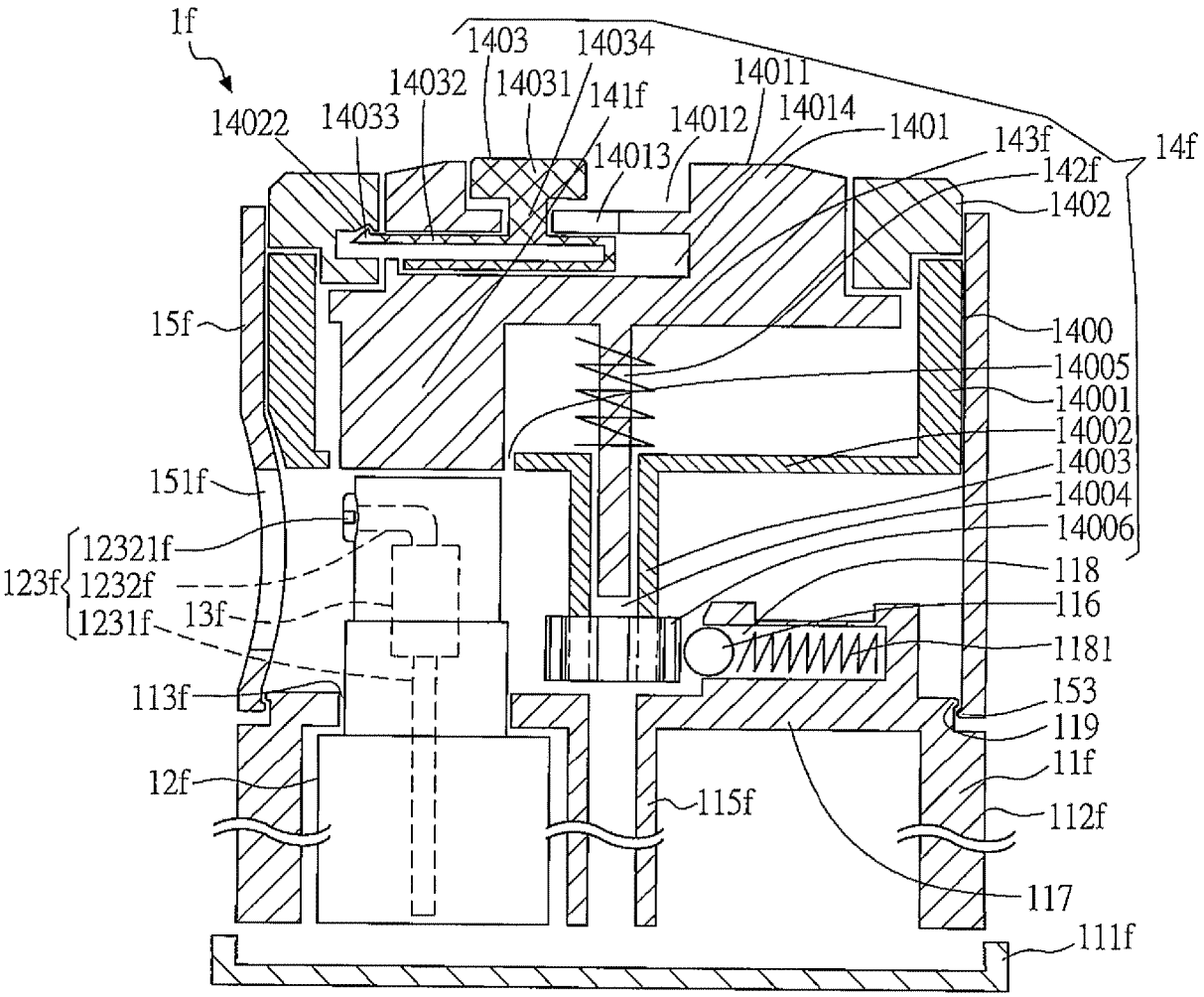
FIG. 17 is a schematically cross-sectional view of a sixth embodiment of the liquid container in accordance with the present invention.

Referring now to FIG. 17, a schematically cross-sectional view of a sixth embodiment of the liquid container in accordance with the present invention is shown. In this sixth embodiment, the liquid container 1*f* includes similarly a casing 11*f*, at least two inner bottles 12*f*, at least one pumping unit 13*f*, at least one turnable selecting mechanism 14*f* and a top cover 15*f*.

The casing 11*f* includes a bottom cover 111*f*, an annular sidewall 112*f* located above the bottom cover 111*f*, at least one opening 113*f* located at another end of the sidewall 112*f* by opposing to the bottom cover 111*f*, and a bottle-accommodating space consisted of the bottom cover 111*f* and the sidewall 112*f* and located between the bottom cover 111*f* and the sidewall 11. In this embodiment, the bottom cover 111*f* is assembled to a bottom of the sidewall 112*f* by, for example, screwing or buckling.

The at least two inner bottles 12*f* are removably received in the bottle-accommodating space of the casing 11*f*. Each of the inner bottles 12*f* includes an inner space for accommodating a liquid, and a draft tube assembly 123*f*. The draft tube assembly 123*f* includes a dip tube 1231*f* extending into the inner space by being close to an in-bottle bottom of the inner bottle 12*f*, and an output tube 1232*f* connected with the dip tube 1231*f* and extending upward from the inner space, through the inner bottle 12*f* and to a preset position out of the opening 113*f* of the casing 11*f*.

The at least one pumping unit 13*f* is connected with the inner bottles 12*f*. When the at least one pumping unit 13*f* is activated by foreign forcing, a pumping force would be provided to the liquid contained in one of the inner bottles 12*f* so as to pump the liquid to the output tube 1232*f* through the dip tube 1231*f* of the draft tube assembly 123*f*.

The at least one turnable selecting mechanism 14*f*, assembled to the casing 11*f*, can undergo a rotation with respect to the casing 11*f*. The selecting mechanism 14*f* is co-moved with the at least one pumping unit 13*f*, so that, when the selecting mechanism 14*f* is turned by another forcing, an action end 141*f* of the selecting mechanism 14*f* would be turned to in correspondence with one of the inner bottles 12*f*, and the inner bottle 12*f* respective to the action end 141*f* is the inner bottle 12*f* that is pumped by the at least one pumping unit 13*f*.

The top cover 15*f* is to cover and engage the sidewall 112*f* of the casing 11*f*. The top cover 15*f* has a liquid outlet 151*f* located at a position at least respective to a tube opening 12321*f* of the output tube 1232*f* of the draft tube assembly 123*f* for the inner bottle 12*f* corresponding to the action end 141*f*.

In this embodiment, the number of the at least one pumping unit 13*f* is preferably equal to that of the inner bottles 12*f*. Each of the inner bottles 12*f* is furnished with a pumping unit 13*f*, and the pumping unit 13*f* is located between the dip tube 1231*f* of the draft tube assembly 123*f* for the inner bottle 12*f* and the output tube 1232*f*. When any of the pumping units 13*f* is depressed, this pumping unit 13*f* would provide a pumping force to the liquid contained in the inner bottle 12*f*.

The selecting mechanism 14*f* is located above the at least one pumping unit 13*f*, and co-moved with the top cover 15*f*. The top cover 15*f* engages on top of the sidewall 112*f* of the casing 11*f* in a rotational manner. When another forcing drives the top cover 15*f* to rotate, the selecting mechanism 14*f* would be rotated synchronously, such that the action end 141*f* can thus be rotated to one of the inner bottles 12*f*. In this embodiment, a lower edge of the top cover 15*f* and an upper edge of the sidewall 112*f* can be furnished with a buckling pair (153 and 119, respectively). Thereupon, the engagement between the top cover 15*f* and the sidewall 112*f* of the casing 11*f* can be ensured, even that the top cover 15*f* undergoes a rotation with respect to the sidewall 112*f* of the casing 11*f*.

The tube openings 12321*f* of the respective output tubes 1232*f* of the corresponding draft tube assemblies 123*f* are directed to different positions of the top cover 15*f*. Largely, the tube openings 12321*f* are located at the same level. The liquid outlet 151*f* is located at the top cover 15*f* by being close to the sidewall 112*f*, and can only be directed to one of the tube openings 12321*f* at a time. Preferably, the positions of the tube openings 12321*f* can be slightly varied to be further close to the liquid outlet 151*f* or the top cover 15*f*.

In the sixth embodiment of the liquid container 1*f* as shown in FIG. 17, the selecting mechanism 14*f* includes a bowl member 1400, a depression head assembly 1401, an elastic member 143*f*, a head ring 1402 and a lock member 1403. The bowl member 1400 includes an annular bowl sidewall 14001, a bowl bottom 14002 located to the lower edge of the bowl sidewall 14001, a hollow axle 14003 located at a center of the bowl bottom 14002, an axial pore 14004 located at a center of the hollow axle 14003, and a penetration hole 14005 located on the bowl bottom 14002 and at a position between the hollow axle 14003 and the bowl sidewall 14001. The bowl sidewall 14001, fixed inside the top cover 15*f*, is moved synchronously with the top cover 15*f*. The bowl bottom 14002 is located by being close to the inner bottles 12*f* and by having the penetration hole 14005 to be positioned above one of the inner bottles 12*f*. The depression head assembly 1401 includes a top surface 14011 exposed above the top cover 15*f*, a locating pin 142*f* located at a lower portion of the depression head assembly 1401 and extending downward, and an action end 141*f* located at another lower portion of the depression head assembly 1401 and extending downward. The depression head assembly 1401 is accommodated within the bowl sidewall 14001 of the bowl member 1400 in a relative up-and-down motion manner. The locating pin 142*f* is to penetrate through the axial pore 14004, so that the locating pin 142*f* can be guided by the axial pore 14004 to undergo a limited up-and-down motion, and further to have the depression head assembly 1401 to undergo another limited up-and-down motion with respect to the bowl member 1400. The action end 141*f* is located respective to the penetration hole 14005, so that, when the depression head assembly 1401 moves downward with respective to the bowl member 1400, a bottom portion of the action end 141*f* would pass through the penetration hole 14005 to depress the pumping unit 13*f* on the inner bottle 12*f* but under the penetration hole 14005. Thereupon, the pumping unit 13*f* would provide the pumping force to the liquid contained in the inner bottle 12*f*.

In this embodiment, by turning the top cover 15*f*, the bowl member 1400 as well as the depression head assembly 1401*a* can be rotated synchronously with respect to the casing 11*f*, such that the penetration hole 14005 and the action end 141*f* can be turned to one of the inner bottles 12*f*. In addition, the inner bottle 12*f* respective to the action end 141*f* is the inner bottle 12*f* that is pumped by the at least one pumping unit 13*f*. The elastic member 143*f* sleeving the locating pin 142*f* is located between the depression head assembly 1401 and the bowl bottom 14002 so as to provide a spring force to freely restore the depression head assembly 1401 back to an initial position. The head ring 1402, located above the bowl sidewall 14001, is fixed to the top cover 15*f* by screwing, fitting, buckling, adhering and any the like, and can hold the depression head assembly 1401 in a position between the head ring 1402 and the bowl bottom 14002, such that accidental fallout of the depression head assembly 1401 with respect to the bowl member 1400 can be avoided. Further, the head ring 1402, the bowl member 1400 and the depression head assembly 1401 are all moved synchronously with the top cover 15*f*.

In the sixth embodiment of the liquid container 1*f* as shown in FIG. 17, the casing 11*f* further has a position portion 117 located at the top portion of the sidewall 112*f*, a central post 115*f* extending downward from a center of the position portion 117 to a place neighboring the bottom cover 111*f*, a blind hole 118 located on the position portion 117 and extending horizontally, a spring 1181 located inside the blind hole 118, and a ball 116 located in the blind hole 118 and contacting the spring 117. The number of the opening 113*f* is preferably equal to that of the inner bottles 121 and the opening 113*f* is located on the position portion 117. Each of the openings 113*f* is in correspondence with a top portion of one inner bottle 12*f*. Thereupon, when the inner bottles 12*f* are sent upward into the bottle-accommodating space of the casing 11, the top end of the pumping unit 13*f* connected with the respective inner bottle 12*f* can extend over the position portion 117 from the corresponding opening 113*f*. In addition, the bowl member 1400 further has a ratchet 14006 located at a lower end of the hollow axle 14003. The ball 116 can constantly contact at a periphery of the ratchet 14006 by the spring force of the spring 117. When the bowl member 1400 as well as the top cover 15*f* are turned together, the ball 116 would undergo an elastic jump motion along the periphery of the ratchet 1400 so as to provide a position function.

In this embodiment, the depression head assembly 1401 further includes a top cavity 14012 formed on the top surface 14011, a sliding slot 14013 located on the top cavity 14012, and an interior cavity 14014 located under the sliding slot 14013. The lock member 1403, located in the top cavity 14012 of the depression head assembly 1401, includes a press-button portion 14031 located inside the top cavity 14012 but exposed to the atmosphere, a connection portion 14034 extending downward from the press-button portion 14031 and located in the sliding slot 14013, an elastic portion 14032 located at a lower end of the connection portion 14034 in the interior cavity 14014, and a hook portion 14033 located at an end of the elastic portion 14032. Also, an inner trench 14022 is located to the head ring 1402 at a place respective to the hook portion 14033. The sliding slot 14013 and the interior cavity 14014 can provide guiding and position-limiting, structurally and functionally, to the connection portion 14034 and the elastic portion 14032, respectively, such that the lock member 1403 can be pushed by foreign forcing to displace between a close position and an open position. When the lock member 1403 is at the close position, the hook portion 14033 would move leftward to notch elastically into the inner trench 14022 of the head ring 1402, so that the depression head assembly 1401 can't be depressed and thus won't displace downward. When the lock member 1403 is at the open position, the hook portion 14033 would move rightward to leave the inner trench 14022 and to retrieve back into the interior cavity 14014 of the depression head assembly 1401, such that the depression head assembly 1401 can be depressed and can move downward. Thereupon, in the case that the liquid container 1*f* is not in use, then the lock member 1403 can be posed in the close position so as to lock on the depression head assembly 1401. Thus, the accident of pumping the liquid out of the inner container 1*f* caused by carelessly depressing the depression head assembly 1401 during transportation or handling can be effectively avoided. In the case that the liquid container 1*f* is in use, then the lock member 1403 can be pushed to the open position, and the top cover 15*f* is turned to align the action end 141*f* of the selecting mechanism 14*f* with the inner bottle 12*f* to be squeezed for the liquid, such that the depression head assembly 1401 can be depressed to have the liquid in the select inner bottle 12*f* to be pumped out from the unique liquid outlet 151*f* located at the top cover 15*f* by the pumping unit 13*f*.

In summary, the liquid container 1 of the present invention mainly includes a casing 11, at least two inner bottles 12, at least one pumping unit 13, at least one turnable selecting mechanism 14 and a top cover 15. The casing 11 is applied to collect thereinside a plurality of inner bottles 12 for containing different liquids, and the top cover 15 is introduced to cover the casing 11. The selecting mechanism 14 is applied to select one of the inner bottles 12 to be squeezed for providing the liquid thereinside. The pumping unit 13 is used to pump out the liquid from the selected inner bottle 12 through a common liquid outlet 151 at the top cover 15. Thereupon, the volume and weight of the liquids necessary to be carried daily would be significantly reduced, and thus usage convenience and compactness can be obtained. In addition, though these inner bottles 12 use one common liquid outlet 151, but since each of the inner bottles 12 has its own draft tube assembly 123 and tube opening 12321, and the liquid outlet 151 can handle one tube opening 12321 at a time; thus, the liquid provided through the unique liquid outlet 151 by squeezing won't be contaminated by the other liquids.

While the present invention has been particularly shown and described with reference to a preferred embodiment, it will be understood by those skilled in the art that various changes in form and detail may be without departing from the spirit and scope of the present invention.

What is claimed is:

1. A liquid container, comprising:

a casing, including a bottom cover, an annular sidewall located above the bottom cover, an opening located at the sidewall by opposing to the bottom cover, and a bottle-accommodating space located between the bottom cover and the sidewall;

at least two inner bottles, removably located in the bottle-accommodating space; each of the at least two inner bottles including an inner space for accommodating a liquid, and a draft tube assembly; the draft tube assembly including a dip tube extending into the inner space by being close to an in-bottle bottom of the respective inner bottle, and an output tube connecting the dip tube by extending upward away the inner bottle from the inner space to a preset position out of the opening of the casing;

at least one pumping unit, connected with the at least two inner bottles; wherein, when the at least one pumping unit is driven, a pumping force is generated to the liquid contained in one of the at least two inner bottles so as to pump out the liquid to the output tube through the dip tube of the draft tube assembly;

a turnable selecting mechanism, rotationally assembled to the casing, co-moved with the at least one pumping unit; wherein, when the selecting mechanism is rotated, an action end of the selecting mechanism is turned to one of the at least two inner bottles, and this inner bottle corresponding to the action end is the aforesaid inner bottle to be pumped by the at least one pumping unit; and a top cover, engaged onto the sidewall of the casing, further including a liquid outlet thereon at a location respective to a tube opening of the output tube of the draft tube assembly for the inner bottle at least corresponding to the action end;

wherein a number of the at least one pumping unit is equal to that of the at least two inner bottles, and each of the at least one pumping unit is located between the dip tube and the output tube of the draft tube assembly of the inner bottle; wherein, when the pumping unit is depressed, the pumping force is provided to the liquid of the respective inner bottle;

wherein the selecting mechanism sleeves the at least one pumping unit and is co-moved with the top cover, and the top cover is rotationally assembled onto the sidewall of the casing; wherein, when the top cover is turned, the selecting mechanism is driven to rotate the action end to select one of the inner bottles;

wherein the tube openings of the individual output tubes of the respective draft tube assemblies are located at different positions at the top cover, but the tube openings are largely located at the same level, and the liquid outlet is located at the top cover by being close to the sidewall and in correspondence with one of the tube openings.

2. The liquid container of claim 1, wherein the turnable selecting mechanism further includes a locating pin located at a center inner the top cover, and an elastic member fixed to an end portion of the locating pin, having a spherical member at one end of the elastic member to be located in a central cavity of a central post inside the casing;

wherein the central post further includes two opposing teeth in the central cavity; wherein, when the central post sleeves the locating pin, these two teeth engage two corresponding sliding slots on the locating pin, such that the top cover undergoes an elastic linear movement along these two sliding slots via the elastic member.

3. The liquid container of claim 2, further including a locating member, the locating member covering and bring mounted onto the casing, the locating member including a plurality of installation caves for positioning the respective inner bottles, a central hole for the central post to penetrate therethrough, and a plurality of position grooves for elastically notching an elastic bump furnished to a preset position on an interior wall of the top cover; wherein the bottom cover engages removably the sidewall, the bottom cover is furnished with a plurality of positioning pins located respectively to the inner bottle for locating the inner bottles, and the positioning pins have a number equal to the number of the inner bottles.

4. The liquid container of claim 1, wherein an installation groove is located at the sidewall of the casing, and a mirror is inserted in the installation groove in a draw-able manner;

wherein at least one pivotal door and at least one installation opening are located at the sidewall of the casing, a number of the at least one installation opening is equal to that of the at least one pivotal door, at least one accommodation space is located behind the pivotal door, the pivotal door pivotally connected to a lateral side of the installation opening is to close or open the installation opening, and the accommodation space is located within the installation opening when the pivotal door is close;

wherein at least one drawer and at least one installation cave are located at the sidewall of the casing, a number of the at least on installation cave is equal to that of the at least one drawer, each of the at least one drawer is furnished with an accommodation space located therebehind, each of the at least one drawer is close or opened within the respective installation cave, and the accommodation space is retrieved into the respective installation cave when the drawer is close.

5. The liquid container of claim 1, wherein the selecting mechanism includes:

a bowl member, further including an annular bowl sidewall, a bowl bottom located to a lower edge of the bowl sidewall, a hollow axle located at a center of the bowl bottom, an axial pore located at a center of the hollow axle, and a penetration hole located on the bowl bottom and at a position between the hollow axle and the bowl sidewall, the bowl sidewall being fixed inside the top cover and moved synchronously with the top cover, the bowl bottom being located by being close to the inner bottles and by having the penetration hole to be positioned above one of the inner bottles; and a depression head assembly, further including a top surface exposed above the top cover, a locating pin located at a lower portion of the depression head assembly and extending downward, and an action end located at another lower portion of the depression head assembly and extending downward, the depression head assembly being accommodated within the bowl sidewall of the bowl member in a relative up-and-down motion manner, the locating pin penetrating through the axial pore, so that the locating pin is guided by the axial pore to undergo a limited up-and-down motion and further to have the depression head assembly to undergo another limited up-and-down motion with respect to the bowl member, the action end being located respective to the penetration hole so that, when the depression head assembly moves downward with respective to the bowl member, a bottom portion of the action end passing through the penetration hole to depress the pumping unit on the inner bottle but under the penetration hole, thereupon the pumping unit providing the pumping force to the liquid contained in the inner bottle;

wherein, by turning the top cover to rotate the bowl member and the depression head assembly with respect to the casing, the penetration hole and the action end are then turned to one of the inner bottles, and the inner bottle in correspondence with the action end is the inner bottle that is pumped by the at least one pumping unit.

6. The liquid container of claim 5, wherein the selecting mechanism further includes an elastic member, a head ring and a lock member, the elastic member sleeving the locating pin and being located between the depression head assembly and the bowl bottom so as to provide a spring force to freely restore the depression head assembly back to an initial position, the head ring being located above the bowl sidewall and fixed to the top cover so as able to hold the depression head assembly in a position between the head ring and the bowl bottom, thus accidental fallout of the depression head assembly with respect to the bowl member being avoided;

wherein the casing further has a position portion located at a top portion of the sidewall, a blind hole located on the position portion, a spring located inside the blind hole, and a ball located in the blind hole and contacting the spring, a number of the opening is equal to that of the inner bottles, and the opening is located on the position portion; wherein, when the inner bottles are sent upward into the bottle-accommodating space of the casing, a top end of the pumping unit connected with the respective inner bottle extends over the position portion from the corresponding opening, the bowl member further has a ratchet located at a lower end of the hollow axle, and the ball constantly contacts at a periphery of the ratchet by the spring; wherein, when the bowl member as well as the top cover are turned together, the ball undergoes an elastic jump motion along a periphery of the ratchet so as to provide a position function;

wherein, the depression head assembly further includes a top cavity formed on the top surface, a sliding slot located on the top cavity, and an interior cavity located under the sliding slot; the lock member located in the top cavity of the depression head assembly includes a press-button portion located inside the top cavity but exposed to the atmosphere, a connection portion extending downward from the press-button portion and located in the sliding slot, an elastic portion located at a lower end of the connection portion in the interior cavity, and a hook portion located at an end of the elastic portion; wherein an inner trench is located to the head ring at a place respective to the hook portion, and the sliding slot and the interior cavity provide guiding and position-limiting, structurally and functionally, to the connection portion and the elastic portion, respectively, such that the lock member is pushed by foreign forcing to displace between a close position and an open position; wherein, when the lock member is at the close position, the hook portion moves leftward to notch elastically into the inner trench of the head ring, so that the depression head assembly can't be depressed and thus won't displace downward; wherein, when the lock member is at the open position, the hook portion moves rightward to leave the inner trench and to retrieve back into the interior cavity of the depression head assembly, such that the depression head assembly is depressed and moves downward.

7. A liquid container, comprising:

a casing, including a bottom cover, an annular sidewall located above the bottom cover, an opening located at the sidewall by opposing to the bottom cover, and a bottle-accommodating space located between the bottom cover and the sidewall;

at least two inner bottles, removably located in the bottle-accommodating space; each of the at least two inner bottles including an inner space for accommodating a liquid, and a draft tube assembly; the draft tube assembly including a dip tube extending into the inner space by being close to an in-bottle bottom of the respective inner bottle, and an output tube connecting the dip tube by extending upward away the inner bottle from the inner space to a preset position out of the opening of the casing;

at least one pumping unit, connected with the at least two inner bottles; wherein, when the at least one pumping unit is driven, a pumping force is generated to the liquid contained in one of the at least two inner bottles so as to pump out the liquid to the output tube through the dip tube of the draft tube assembly;

a turnable selecting mechanism, rotationally assembled to the casing, co-moved with the at least one pumping unit; wherein, when the selecting mechanism is rotated, an action end of the selecting mechanism is turned to one of the at least two inner bottles, and this inner bottle corresponding to the action end is the aforesaid inner bottle to be pumped by the at least one pumping unit; and a top cover, engaged onto the sidewall of the casing, further including a liquid outlet thereon at a location respective to a tube opening of the output tube of the draft tube assembly for the inner bottle at least corresponding to the action end;

wherein an installation groove is located at the sidewall of the casing, and a mirror is inserted in the installation groove in a draw-able manner;

wherein at least one pivotal door and at least one installation opening are located at the sidewall of the casing, a number of the at least one installation opening is equal to that of the at least one pivotal door, at least one accommodation space is located behind the pivotal door, the pivotal door pivotally connected to a lateral side of the installation opening is to close or open the installation opening, and the accommodation space is located within the installation opening when the pivotal door is close;

wherein at least one drawer and at least one installation cave are located at the sidewall of the casing, a number of the at least on installation cave is equal to that of the at least one drawer, each of the at least one drawer is furnished with an accommodation space located therebehind, each of the at least one drawer is close or opened within the respective installation cave, and the accommodation space is retrieved into the respective installation cave when the drawer is close.

8. A liquid container, comprising:

a casing, including a bottom cover, an annular sidewall located above the bottom cover, an opening located at the sidewall by opposing to the bottom cover, and a bottle-accommodating space located between the bottom cover and the sidewall;

at least two inner bottles, removably located in the bottle-accommodating space; each of the at least two inner bottles including an inner space for accommodating a liquid, and a draft tube assembly; the draft tube assembly including a dip tube extending into the inner space by being close to an in-bottle bottom of the respective inner bottle, and an output tube connecting the dip tube by extending upward away the inner bottle from the inner space to a preset position out of the opening of the casing;

at least one pumping unit, connected with the at least two inner bottles; wherein, when the at least one pumping unit is driven, a pumping force is generated to the liquid contained in one of the at least two inner bottles so as to pump out the liquid to the output tube through the dip tube of the draft tube assembly;

a turnable selecting mechanism, rotationally assembled to the casing, co-moved with the at least one pumping unit; wherein, when the selecting mechanism is rotated, an action end of the selecting mechanism is turned to one of the at least two inner bottles, and this inner bottle corresponding to the action end is the aforesaid inner bottle to be pumped by the at least one pumping unit; and a top cover, engaged onto the sidewall of the casing, further including a liquid outlet thereon at a location respective to a tube opening of the output tube of the draft tube assembly for the inner bottle at least corresponding to the action end;

wherein the at least one pumping unit is located at one of the casing and the top cover, the liquid container further includes a plurality of rib elements arranged into a radial array to bridge an interior surface of the sidewall and a hollow central post extending along an axial central line of the casing, and each of the rib elements is further furnished with a ventilation duct; wherein, when the pumping unit is depressed, an air pressure is generated and provided to one of the inner bottles via the corresponding ventilation duct, such that the liquid inside the one of the inner bottles is pumped out to the output tube through the dip tube of the corresponding draft tube assembly by the air pressure; wherein each of the inner bottles has an air-intake hole, the selecting mechanism includes a liquid-guiding member, the action end formed as an air inlet is located at the liquid-guiding member, and the liquid-guiding member is connected spatially with the ventilation duct, so that the air pressure from the pumping unit is guided to the air inlet through the liquid-guiding member; wherein, when the selecting mechanism is turned, a position of the air inlet is shifted to one of the air-intake holes of the corresponding inner bottles.

9. The liquid container of claim 8, wherein the selecting mechanism further includes a rotatable base member and a center pillar engaged at a center of the base member, the base member is removably connected to a bottom end of the casing, the center pillar penetrates the hollow central post, the liquid-guiding member formed as a ring has a central through hole, the liquid-guiding member is fixed to a top end of the center pillar via a fixation pair of a key and a key slot at the top end of the center pillar, and the liquid-guiding member is inserted into an annular groove at another top end of the central post, such that the base member and the liquid-guiding member rotate synchronously; wherein the annular groove is connected spatially with the pumping unit via the ventilation duct, the annular groove includes thereinside at least one conducting hole, and one opening end of the conducting hole is in correspondence with the air-intake hole of the respective inner bottle while another opening end thereof is in correspondence with at least one bump point at an annular periphery of the liquid-guiding member; wherein, when the air inlet is turned to be in correspondence with the air-intake hole of the respective inner bottle, the at least one bump point seals individually the air-intake holes of the other inner bottles;

wherein two gasket rings are furnished individually to the annular periphery and an interior wall of the liquid-guiding member, respectively, such that, when the liquid-guiding member is inserted into the annular groove, an airtight effect is thus obtained.

10. The liquid container of claim 9, wherein, after the output tube of each the draft tube assembly extends over the opening of the casing, the output tube further extends to the liquid outlet of the top cover, so that these tube openings of the draft tube assemblies are all directed to the liquid outlet of the top cover; wherein the inner bottle further includes an inner-bottle cap and a restoring spring, the inner-bottle cap drives the restoring spring to elastically fix the draft tube assembly in the respective inner bottle, one end of the restoring spring is fixed to the inner bottle while another end thereof is fixed to the dip tube, a collar ring is furnished to the output tube by spacing from the inner-bottle cap at least by a preset distance, a spring plate is provided to the annular periphery of the liquid-guiding member, and the spring plate is bent to an arc shape having a tip higher than the liquid-guiding member and located at a position respective to the air inlet; wherein, when the air inlet is in correspondence with the air-intake hole of one of the inner bottles, the spring plate enters a space defining the preset distance between the collar ring and the inner-bottle cap so as to push the collar ring upward by a predetermined distance, such that the tube opening of the output tube is further close to or over the liquid outlet of the top cover.

* * * * *